US005915553A

United States Patent [19]

Brown et al.

[11] Patent Number: 5,915,553

[45] Date of Patent: Jun. 29, 1999

[54] STORAGE ORGANIZERS

[75] Inventors: Jerrold G. Brown, Medina; Randall W. Calmeise, Oakwood Village, both of Ohio

[73] Assignee: Akro-Mils, Akron, Ohio

[21] Appl. No.: 08/908,765

[22] Filed: Aug. 7, 1997

Related U.S. Application Data

[63] Continuation-in-part of application No. 29/058,232, Aug. 9, 1996, Pat. No. Des. 387,295.

[51] Int. Cl.[6] ..... B65D 85/28

[52] U.S. Cl. ..... 206/372; 206/561; 220/521

[58] Field of Search ..... 206/561, 576, 206/315.11, 372, 373; 220/523, 526, 521

[56] References Cited

U.S. PATENT DOCUMENTS

| | | | |
|---|---|---|---|
| 10,598 | 5/1854 | Price | 206/315.11 |
| D. 314,669 | 2/1991 | Kunimune | D3/76 |
| D. 321,985 | 12/1991 | Ward | D3/73 |
| D. 343,063 | 1/1994 | Chen | D3/78 |
| D. 347,731 | 6/1994 | Hayakawa et al. | D3/282 |
| D. 357,117 | 4/1995 | Huang | D3/276 |
| D. 367,557 | 3/1996 | Chang | D3/276 |
| 2,125,856 | 8/1938 | De Witt | 220/526 |
| 2,687,157 | 8/1954 | Cowan | 150/0.5 |
| 2,718,326 | 9/1955 | Le Blanc | 206/561 |
| 2,731,996 | 1/1956 | Hayes | 206/561 |
| 3,258,017 | 6/1966 | Albert | 206/561 |
| 4,615,464 | 10/1986 | Byrns | 220/469 |
| 4,951,812 | 8/1990 | Chen | 206/45.11 |
| 4,998,616 | 3/1991 | Hillinger | 206/45.11 |
| 5,114,007 | 5/1992 | Chen | 206/373 |
| 5,344,024 | 9/1994 | Cohu | 220/526 |
| 5,680,932 | 10/1997 | Dickinson | 206/372 |
| 5,826,718 | 10/1998 | Ahern, Jr. et al. | 206/372 |
| 5,826,719 | 10/1998 | Chen | 206/373 |

*Primary Examiner*—David T. Fidei
*Attorney, Agent, or Firm*—Oldham & Oldham Co., L.P.A.

[57] ABSTRACT

Storage organizers assembly having a plurality of dividers which divide a bottom enclosure into separate storage sections. At least some of the dividers are independently insertable and removable to create storage sections of various sizes and configurations. The top and bottom surfaces of the storage organizers include a plurality of curved surfaces to make the storage organizers more visually appealing and adding strength and reducing warpage of these surfaces. Storage organizers in accordance with the present invention also includes a latching arrangement which is easy to use and securely closes the storage organizers.

1 Claim, 18 Drawing Sheets

STORAGE ORGANIZERS

This utility patent application is a continuation-in-part of U.S. design patent application Ser. No. 29/058,232 filed Aug. 9, 1996, now U.S. Pat. No. D. 387,295 for a "Storage Organizer."

BACKGROUND AND SUMMARY OF THE INVENTION

The present invention relates generally to new and novel improvements in storage organizers. More particularly, the present invention relates to storage organizers which include a plurality of separate compartments for placing, storing and retrieving relatively small household and industrial items and the like therein.

Storage organizers having hinged lid members have been in common use for the storage of small items, such as fasteners, sewing supplies, electronic components and the like, and are widely used in a variety of household, construction, repair and maintenance applications. Such storage organizers typically include a bottom enclosure which often includes a plurality of dividers which divide the bottom enclosure into a plurality of separate compartments where such items can be placed, stored and retrieved. Storage organizers have traditionally been used to store items such as screws, nails, bolts, nuts, plumbing fittings, electrical connectors therein.

In many prior art storage organizers, the dividers which divide the bottom enclosure into separate sections are supported only on their sides and a gap remains between the installed dividers and the bottom enclosure and/or the cover. Such gaps permit relatively small items stored therein to move or "migrate" from the compartment in which they were placed to adjacent compartments by passing either below and/or above the dividers. This problem of movement or "migration" of relatively small items to adjacent compartments is particularly great when the storage organizer experiences vibration or is moved to different orientations, such as when the storage organizer is picked up and carried or transported in a motor vehicle.

In addition, most prior art storage organizers known to applicant are substantially rectangular in configuration and have a substantially flat top and bottom surface. Such substantially flat top and bottom surfaces are not only visually unappealing, but tend to warp and lack adequate rigidity and strength. Furthermore, most prior art storage organizers rely on a resilient latching of an outwardly extending protrusion on the bottom enclosure and/or the cover over a corresponding lip on the other of the bottom enclosure and/or the cover. Such prior art latching arrangements are not only difficult to use, but also tend to "pop" open if such storage organizers are dropped onto a hard surface, such as a floor or countertop, thus allowing the contents of the storage organizer to spill and escape.

Accordingly, an object of the present invention is the provision of storage organizers having a plurality of dividers which create separate compartments for storing relatively small items and/or supplies which preclude movement or "migration" of the relatively small items and/or supplies to adjacent compartments.

Another object of the present invention is to provide storage organizers which include a series of curved portions on their top and bottom surfaces to make the storage organizers visually appealing, add rigidity and strength and prevent warpage of the top and bottom surfaces of the storage organizers and assist a user in removing relatively small parts stored in the separate compartments therein.

Yet another object of the present invention is to provide storage organizers having a latching arrangement which is easy to use and securely holds such storage organizers in a closed position.

These and other objects of the present invention are attained by the provision of storage organizers assembly having a plurality of dividers which divide a bottom enclosure into separate storage compartments. At least some of the dividers are independently insertable and removable to create storage compartments of various sizes and configurations. The top and bottom surfaces of the storage organizers include a plurality of curved portions to make the storage organizers more visually appealing, add rigidity and strength and reduce warpage of these surfaces and assist a user in removing the small items stored in the separate compartments from the storage organizers. Storage organizers in accordance with the present invention also includes a latching arrangement which is easy to use and securely holds the storage organizers in a closed position.

Other advantages and novel features of the present invention will become apparent in the following detailed description of the invention when considered in conjunction with the accompanying drawings.

DETAILED DESCRIPTION OF THE DRAWINGS

Figure 1:
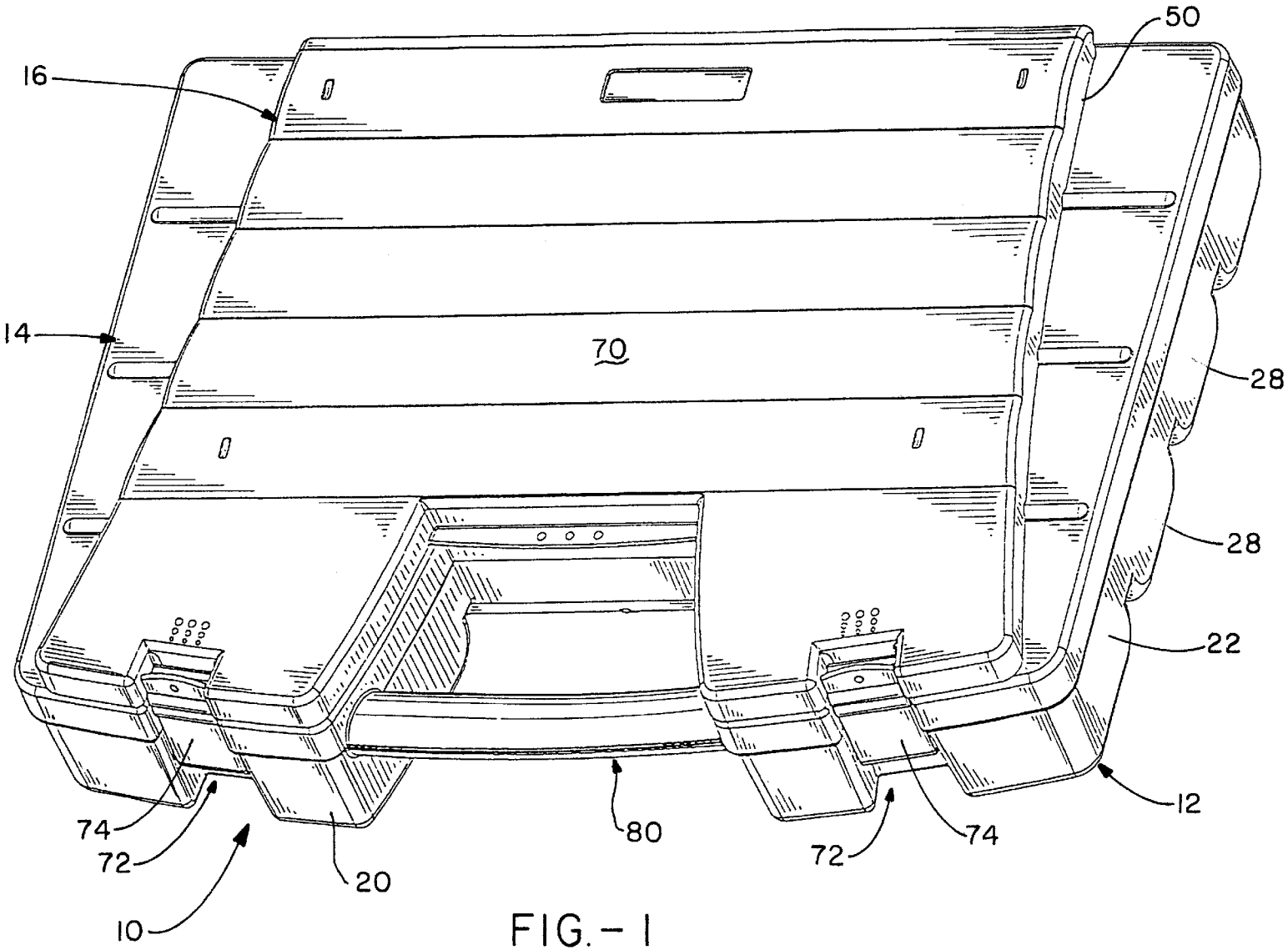
FIG. 1 is a top isometric view of a storage organizer in accordance with a first preferred embodiment of the present invention.
Figure 2:
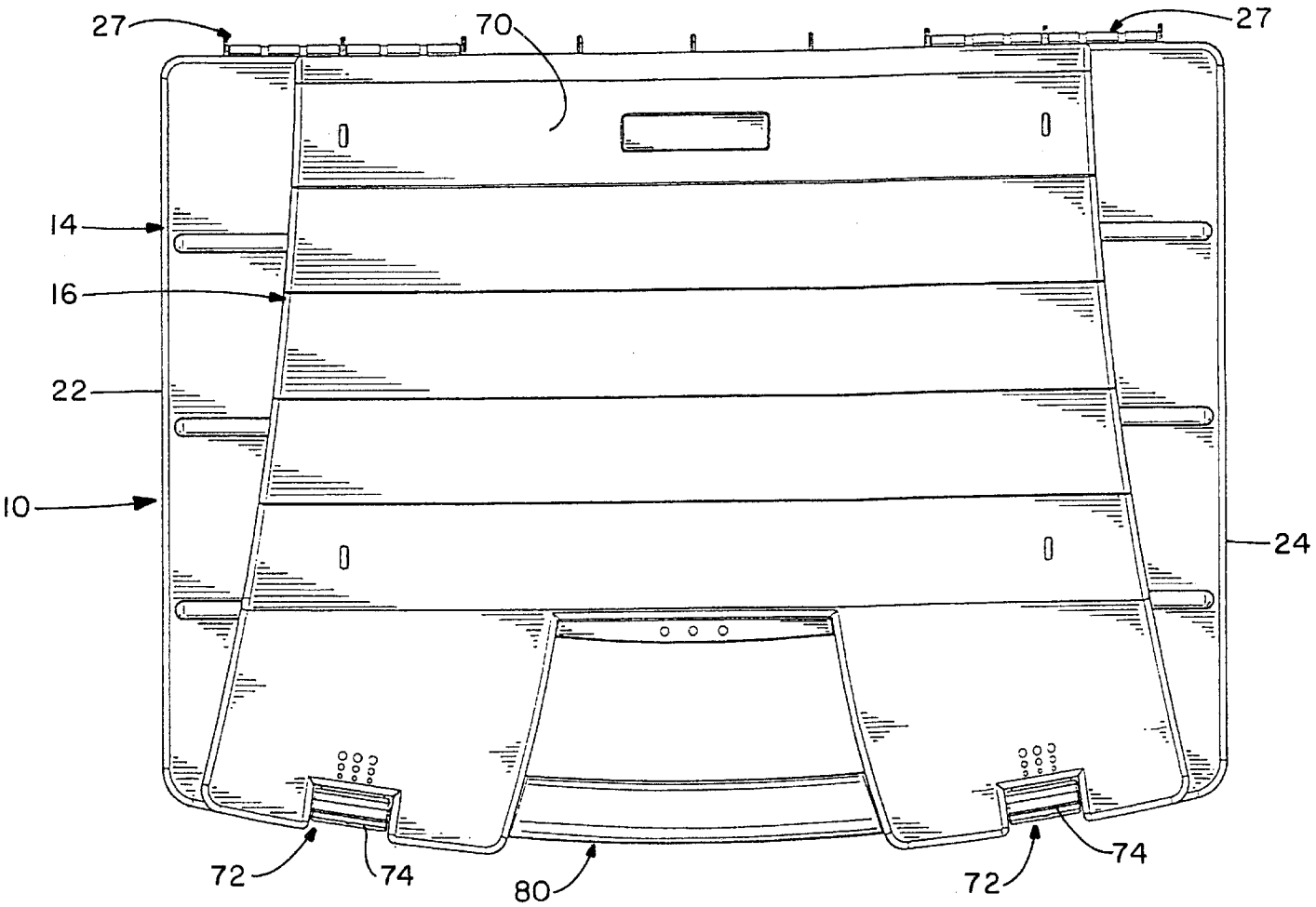
FIG. 2 is a top view of the storage organizer in accordance with the first preferred embodiment of the present invention shown in FIG. 1.
Figure 3:
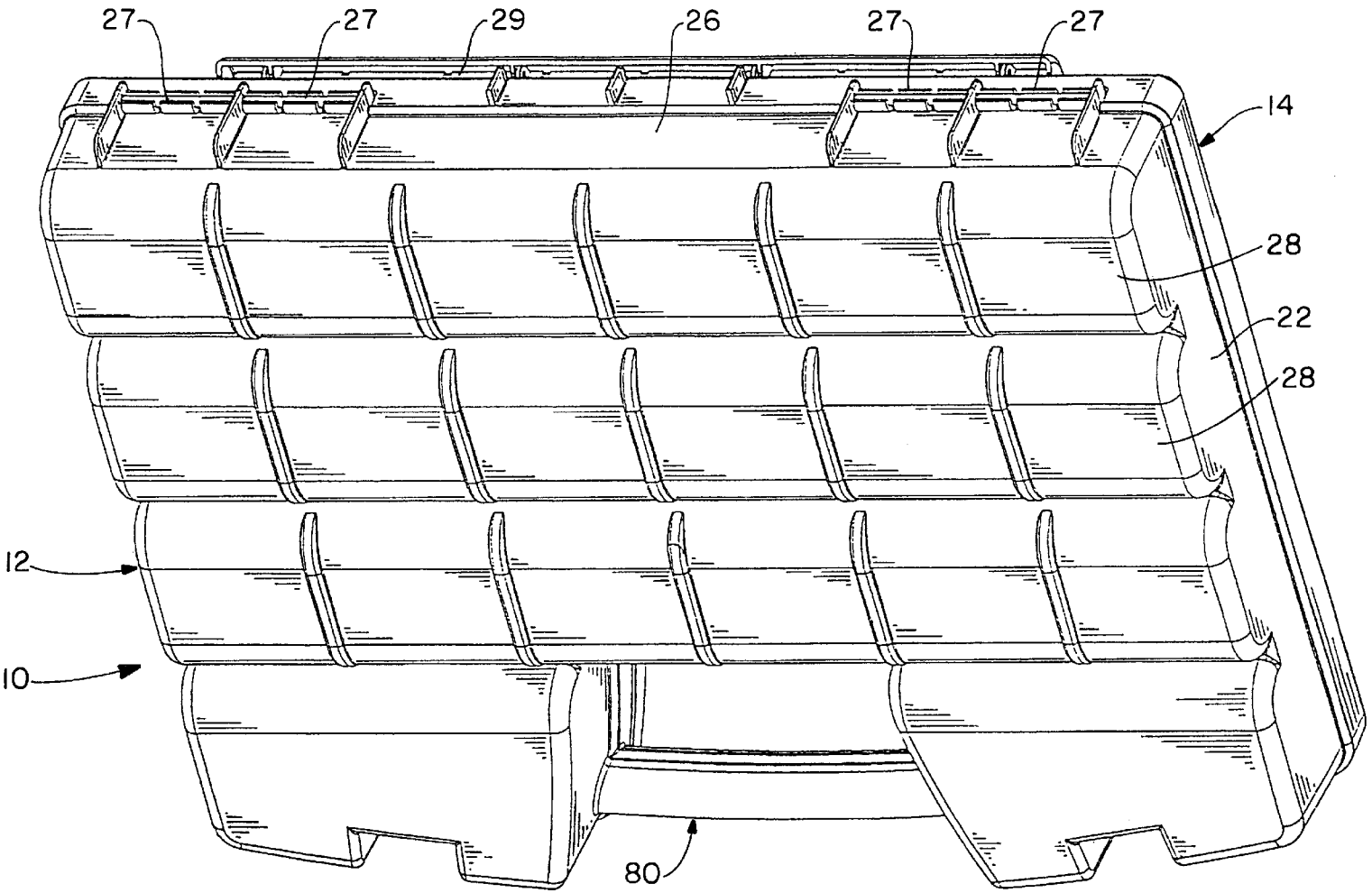
FIG. 3 is a bottom isometric view of the storage organizer in accordance with the first preferred embodiment of the present invention shown in FIG. 1.
Figure 4:
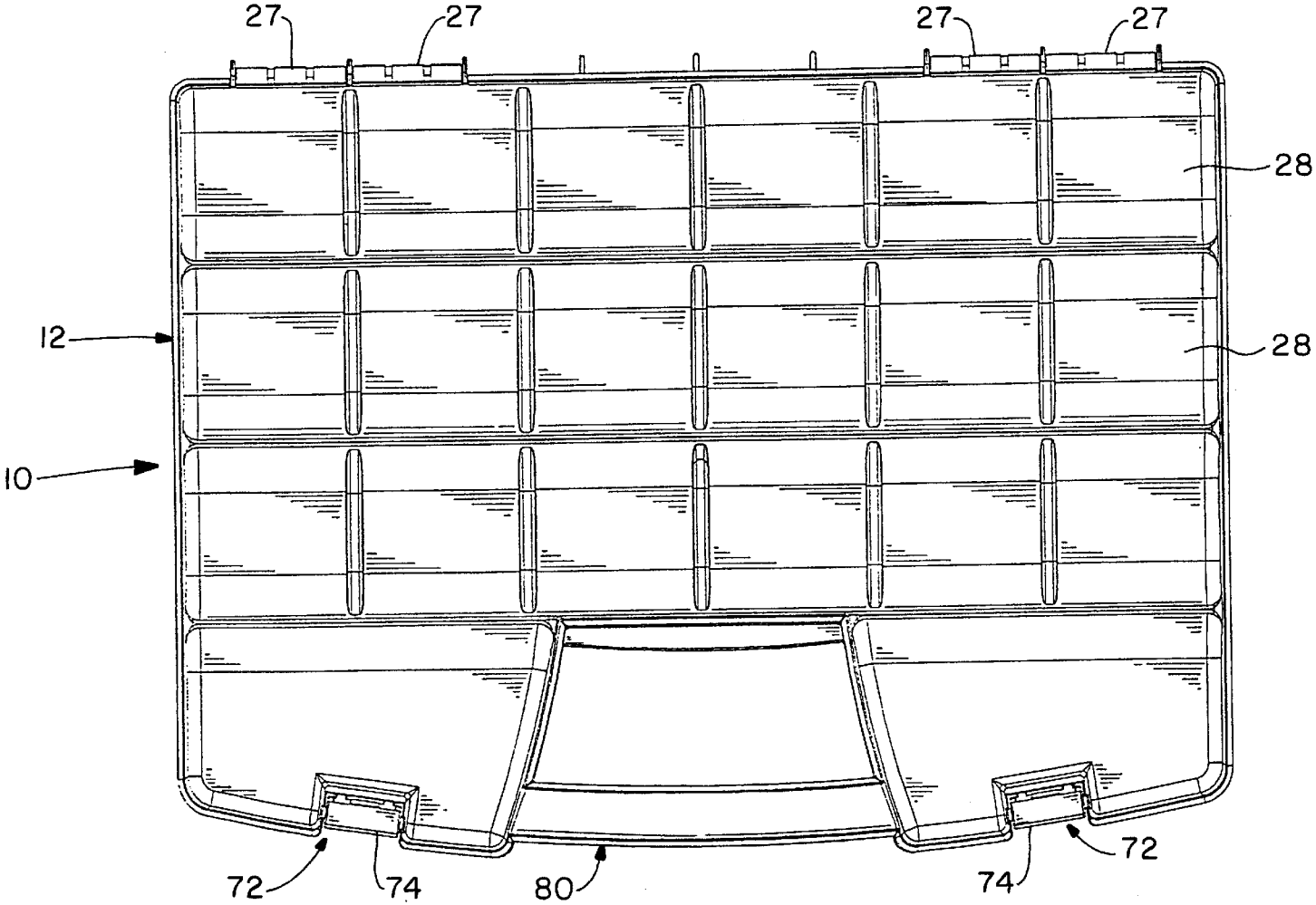
FIG. 4 is a bottom view of the storage organizer in accordance with the first preferred embodiment of the present invention shown in FIG. 1.
Figure 5:
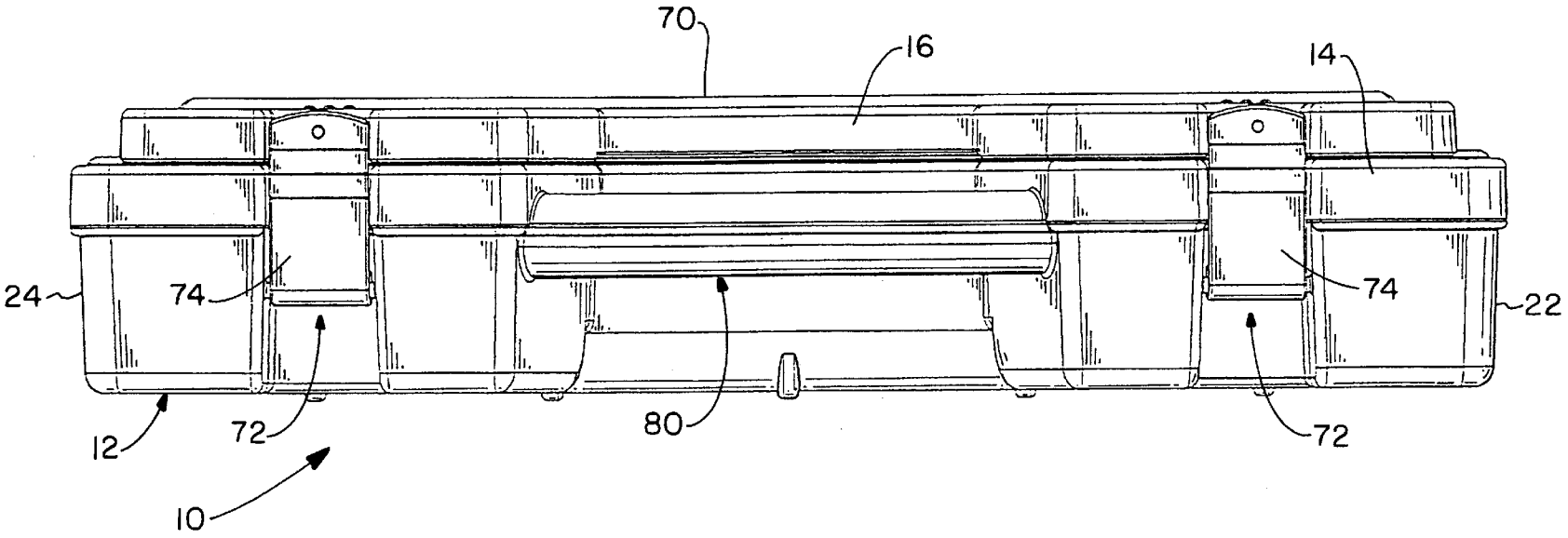
FIG. 5 is a front elevational view of the storage organizer in accordance with the first preferred embodiment of the present invention shown in FIG. 1.
Figure 6:
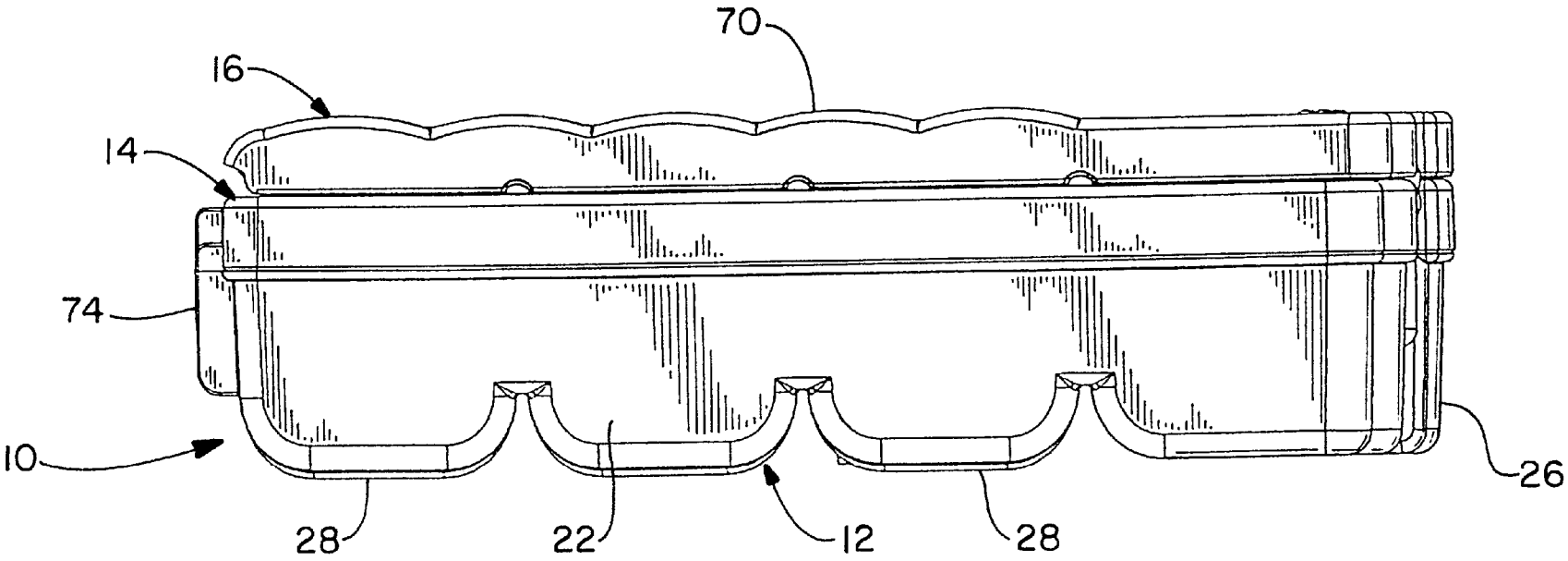
FIG. 6 is a side elevational view of the storage organizer in accordance with the first preferred embodiment of the present invention shown in FIG. 1, the opposite side being a mirror image thereof.
Figure 7:
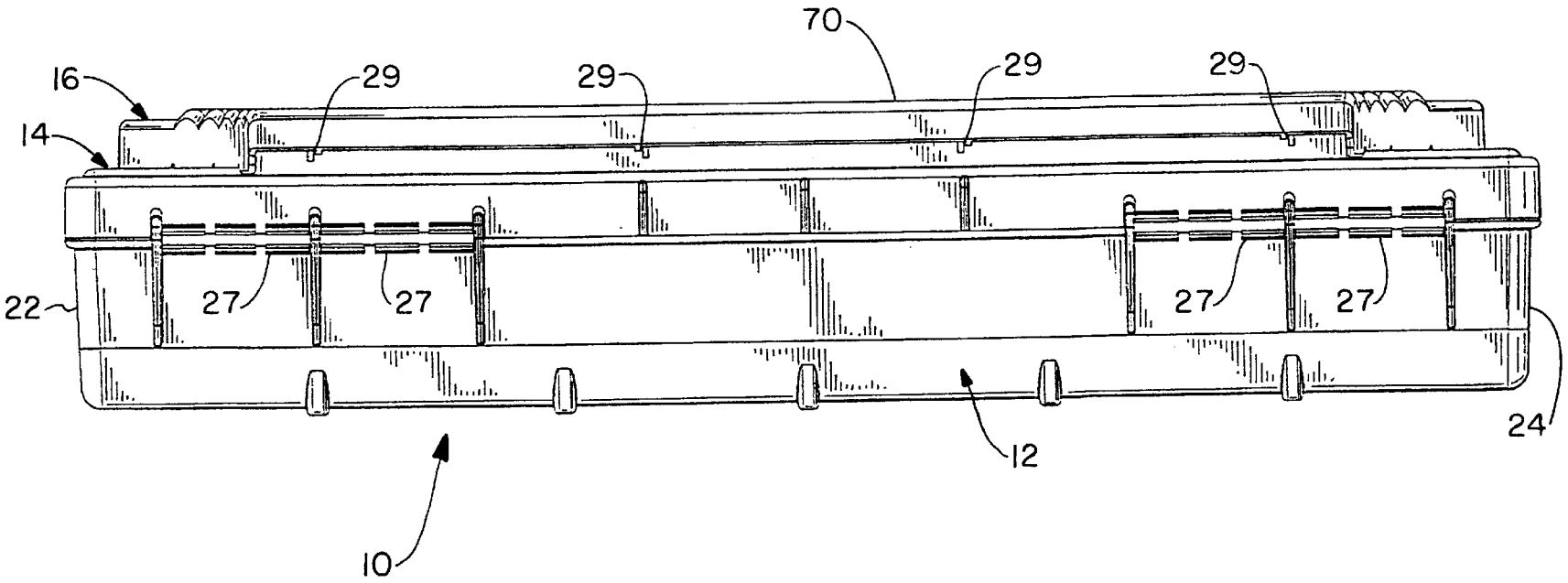
FIG. 7 is a rear elevational view of the storage organizer in accordance with the first preferred embodiment of the present invention shown in FIG. 1.

In the following detailed description of preferred embodiments of the present invention, reference is made to the accompanying drawings which, in conjunction with this detailed description, illustrate and describe a first and a second preferred embodiment of a storage organizer in accordance with the present invention. As seen in FIGS. 1 through 9, the first preferred embodiment of a storage organizer in accordance with the present invention, generally identified by reference numeral 10, includes bottom enclosure 12, first lid member 14 and second lid member 16. Bottom enclosure 12 includes base portion 18, from which front wall 20, side walls 22 and 24 and rear wall 26 upwardly extend. Base portion 18 of bottom enclosure 12 includes a plurality of curved portions 28, four (4) of which are present in the first preferred embodiment of storage organizer 10 shown in FIGS. 1 through 9. Curved portions 28 enhance the visual appeal of storage organizer 10, adds rigidity and strength and precludes warpage of base portion 18 and assists users in removing relatively small items stored within storage organizer 10 as will be described subsequently in this specification.

Figure 8:
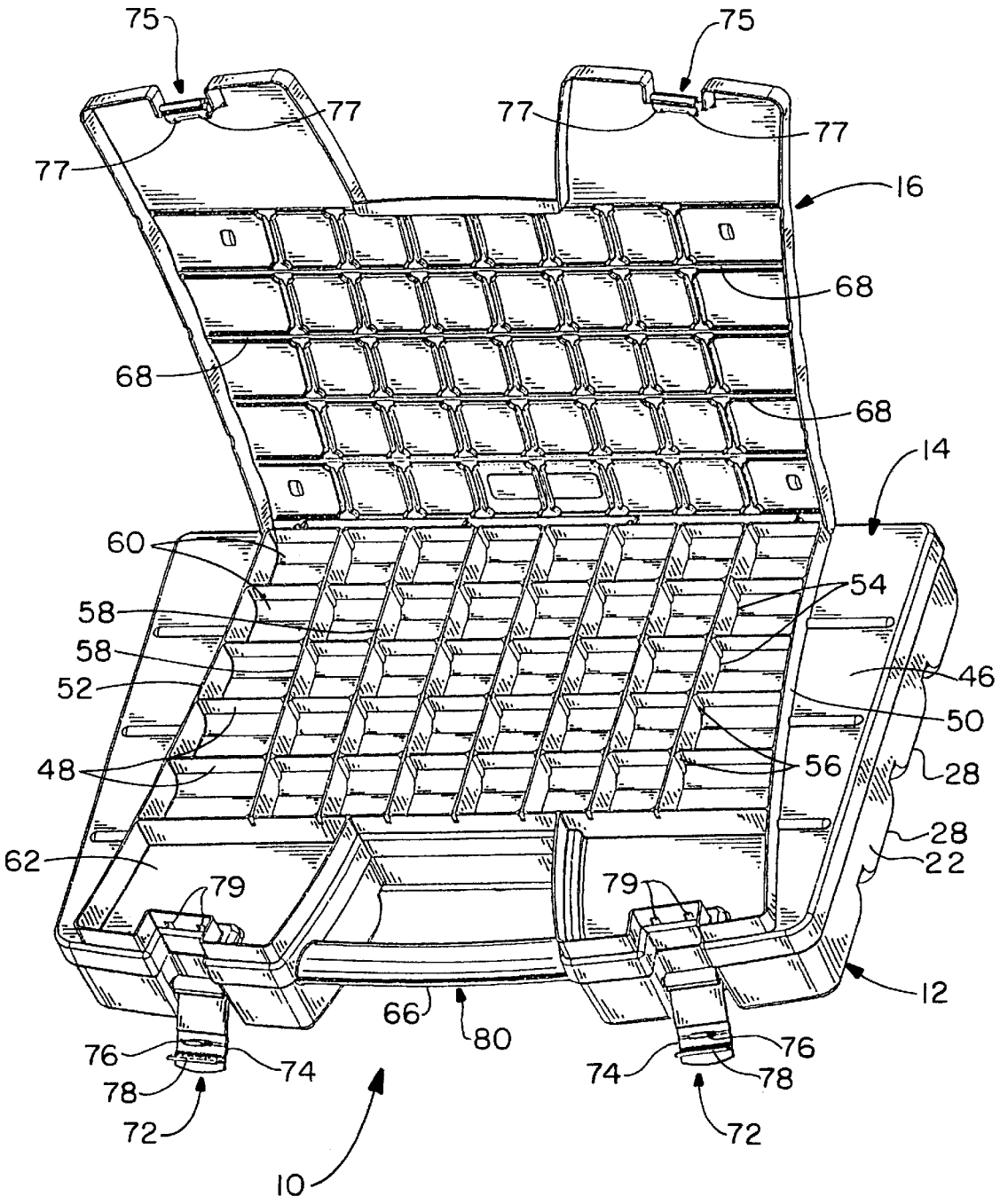
FIG. 8 is a top isometric view of the storage organizer in accordance with the first preferred embodiment of the present invention shown in FIG. 1 with a first lid in an open position.
Figure 9:
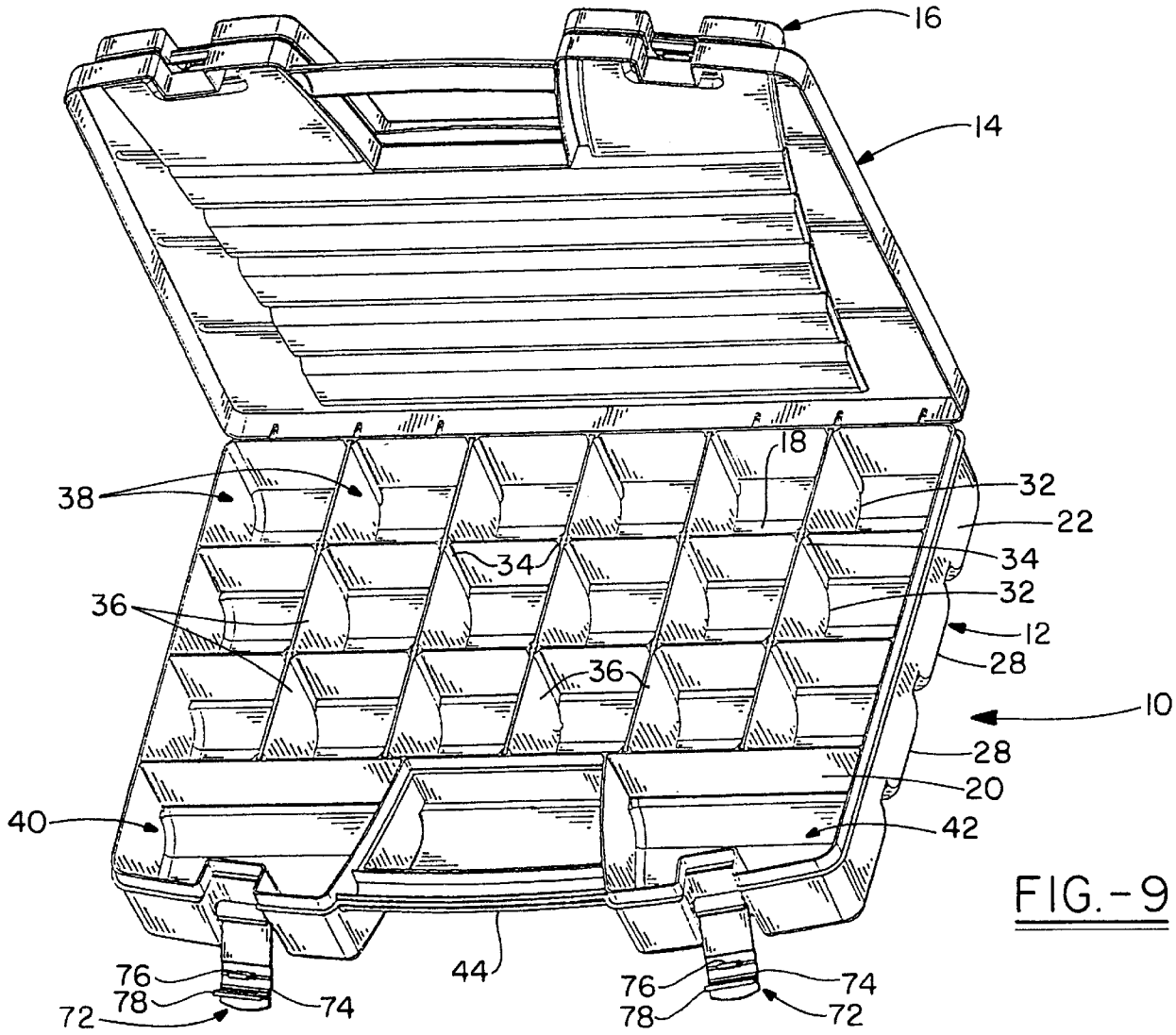
FIG. 9 is a top isometric view of the storage organizer in accordance with the first preferred embodiment of the present invention shown in FIG. 1 with a second lid in an open position.
Figure 10:
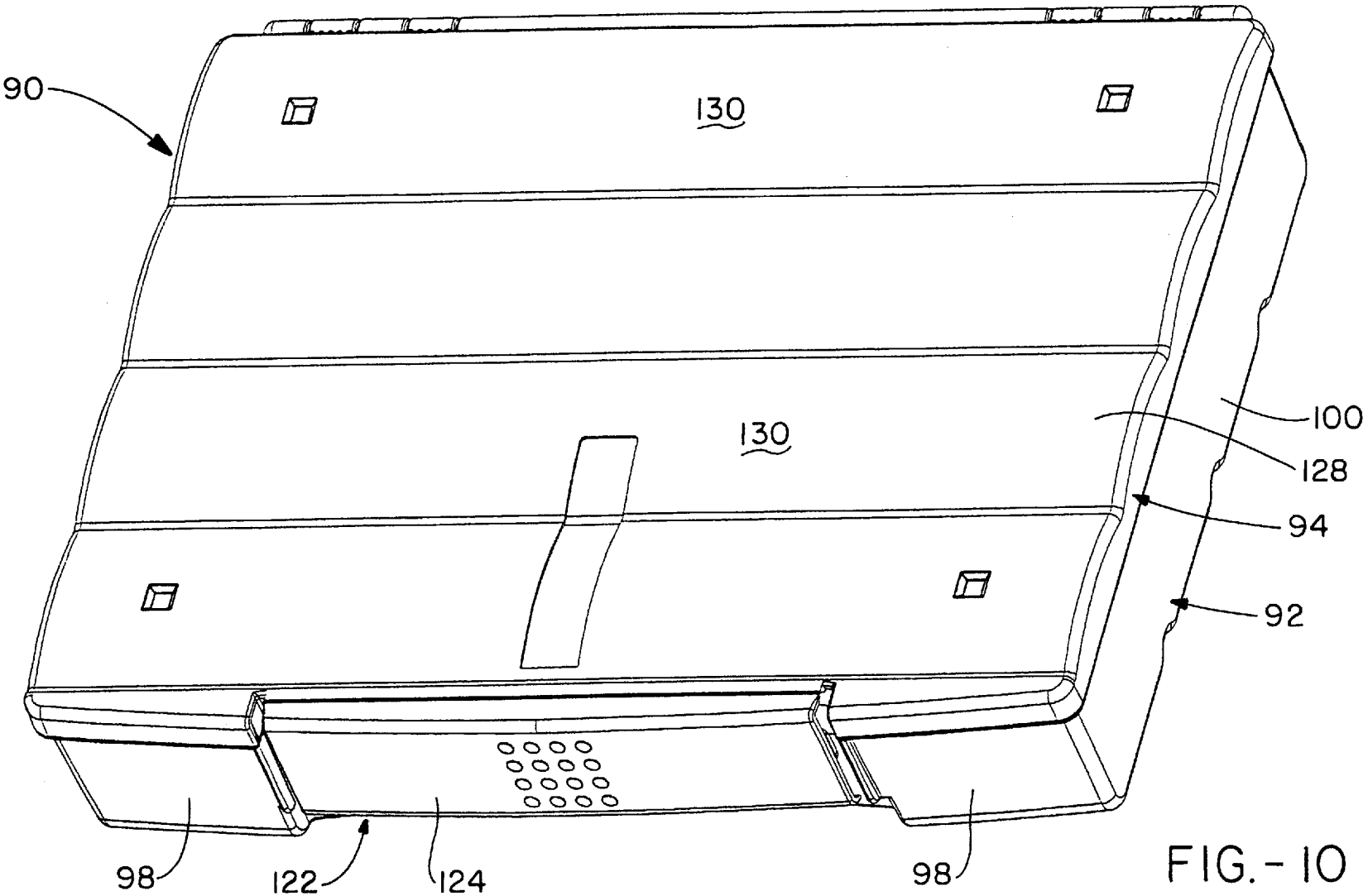
FIG. 10 is a top isometric view of a storage organizer in accordance with a second preferred embodiment of the present invention.
Figure 11:
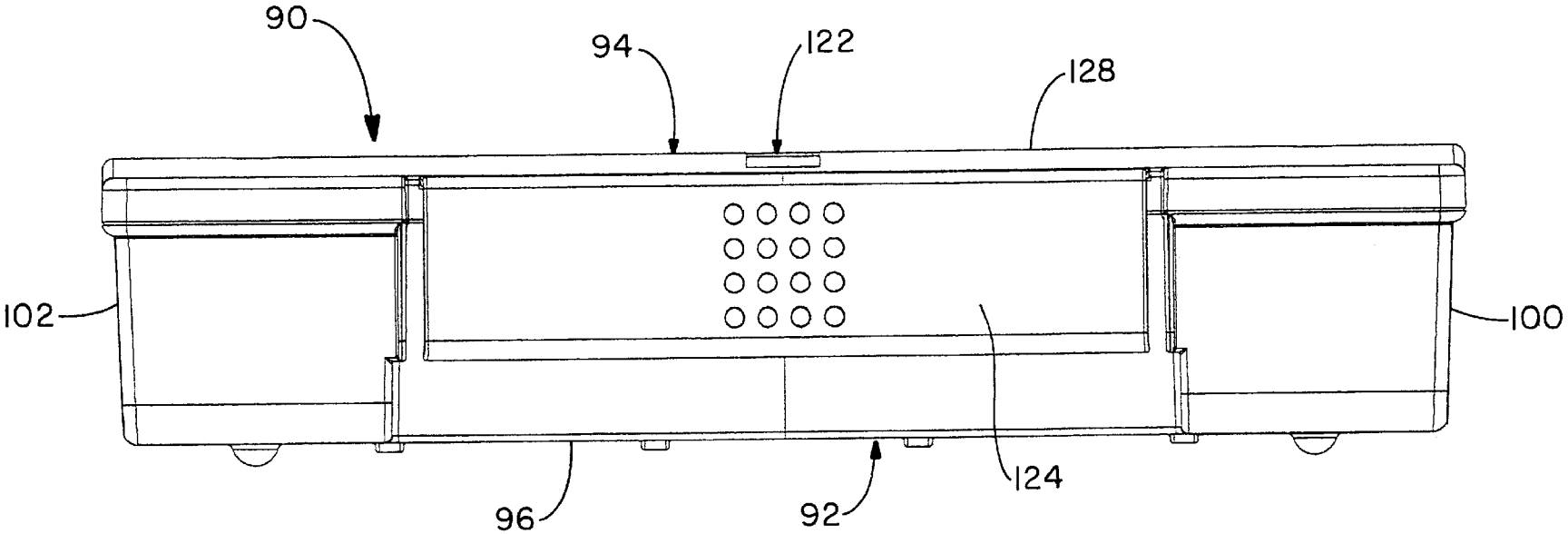
FIG. 11 is a front view of the storage organizer in accordance with the second preferred embodiment of the present invention shown in FIG. 10.
Figure 12:
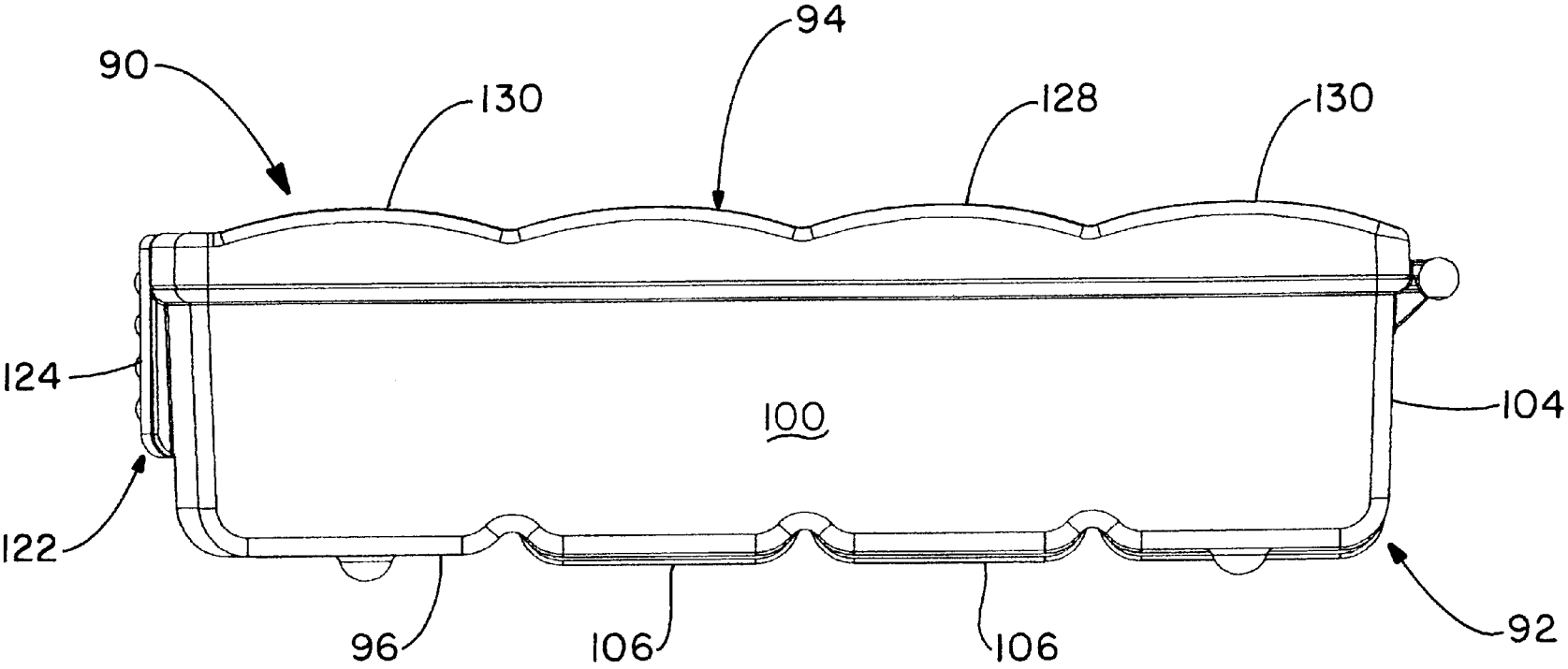
FIG. 12 is a right side view of the storage organizer in accordance with the second preferred embodiment of the present invention shown in FIG. 10, the left side view being a mirror image thereof.
Figure 13:
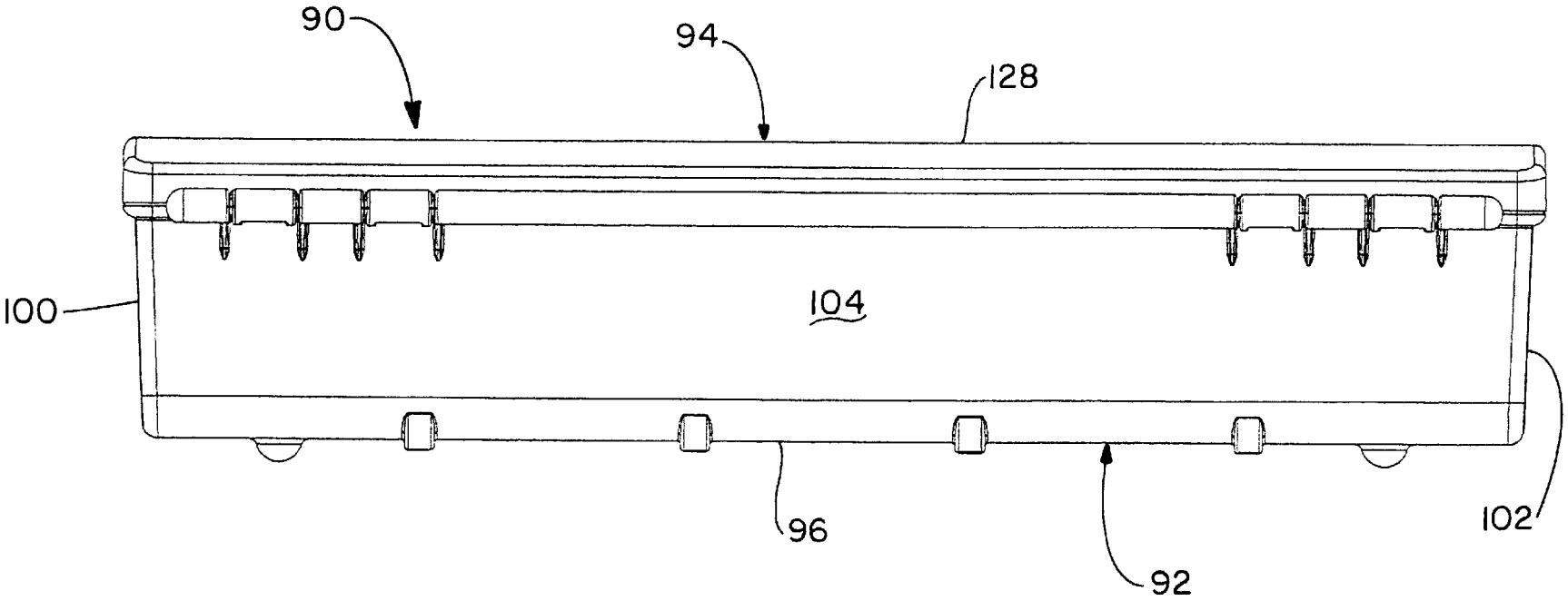
FIG. 13 is a rear view of the storage organizer in accordance with the second preferred embodiment of the present invention shown in FIG. 10.
Figure 14:
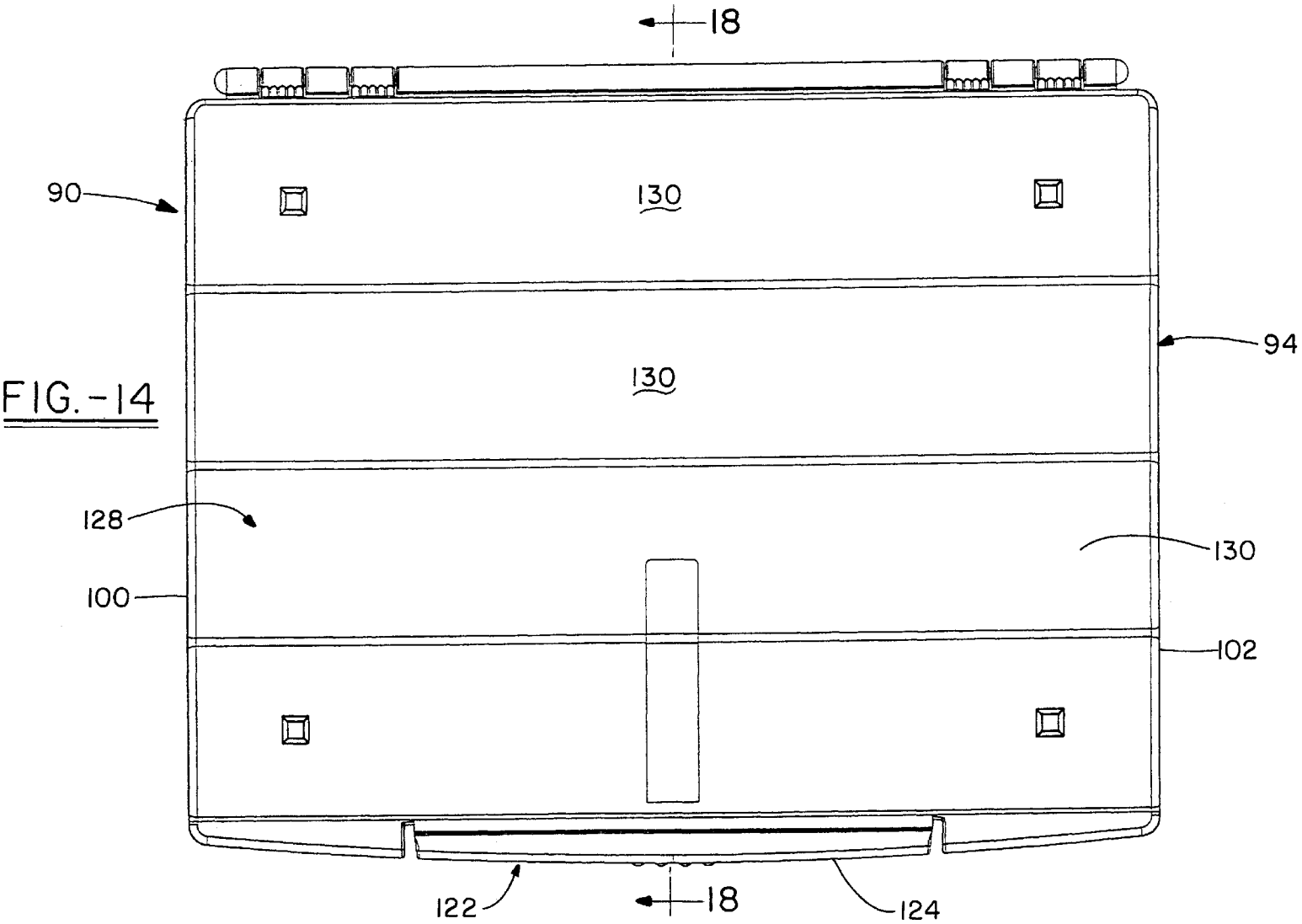
FIG. 14 is a top view of the storage organizer in accordance with the second preferred embodiment of the present invention shown in FIG. 10.
Figure 15:
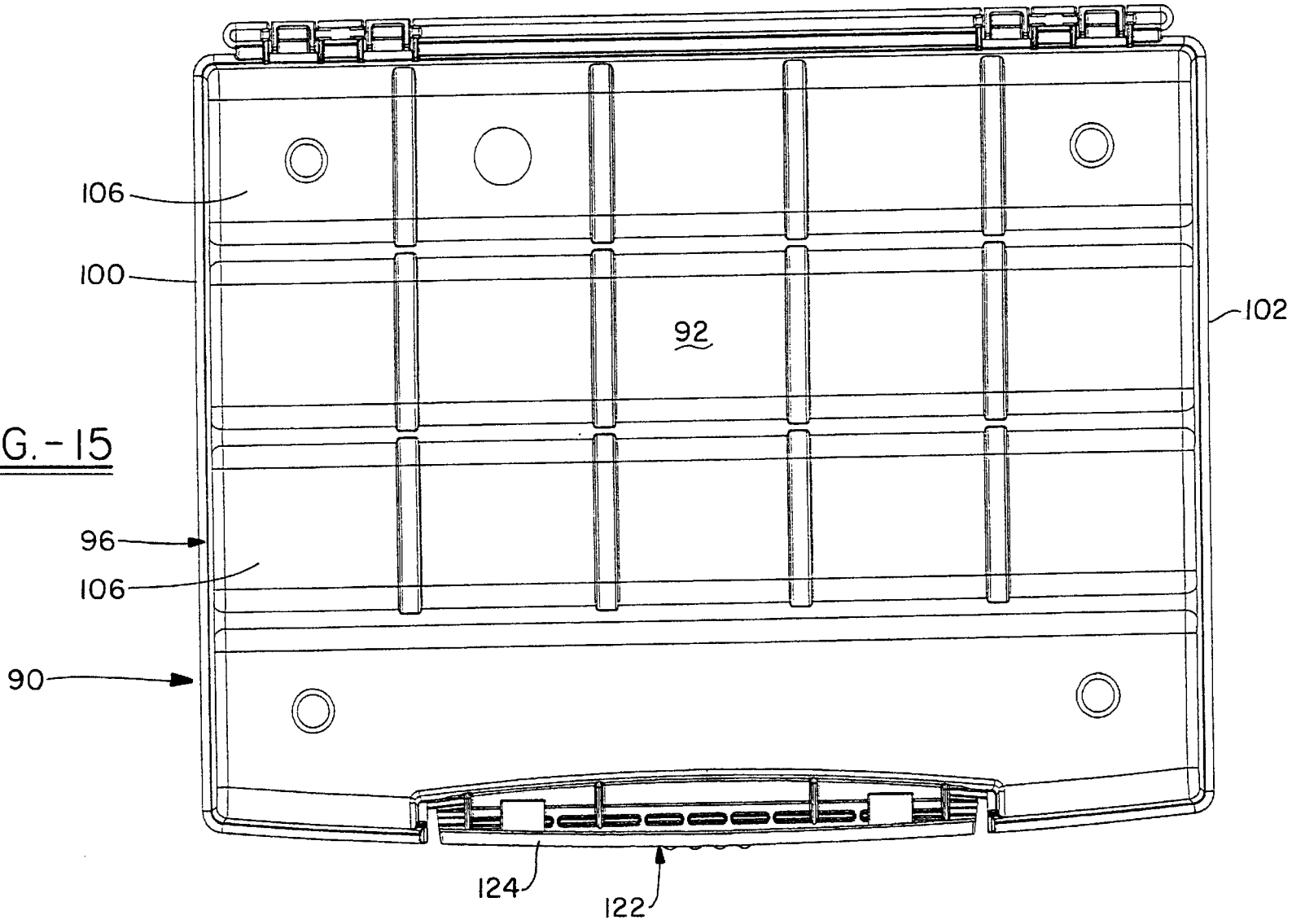
FIG. 15 is a bottom view of the storage organizer in accordance with the second preferred embodiment of the present invention shown in FIG. 10.
Figure 16:
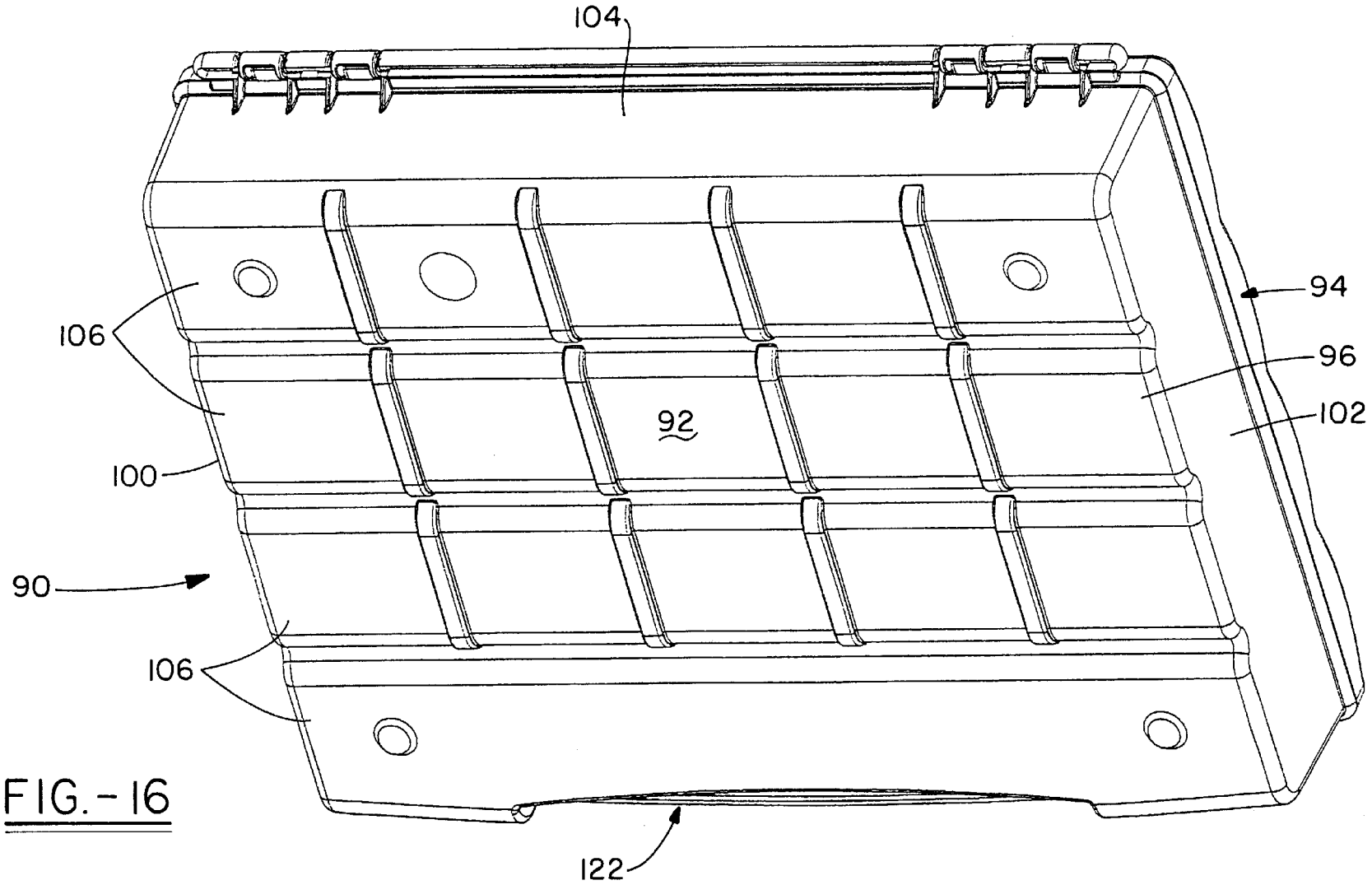
FIG. 16 is a bottom isometric view of the storage organizer in accordance with the second preferred embodiment of the present invention shown in FIG. 10.

As seen in FIG. 9, bottom enclosure 12 includes a plurality of horizontally extending dividers 30, four (4) of which are present in the first preferred embodiment of storage organizer 10 shown in FIGS. 1 through 9, which extend from side wall 22 to side wall 24. Horizontally extending dividers 30 are preferably permanently affixed to bottom enclosure 12, however, horizontally extending dividers 30 could also be made to be removable if desired. Horizontally extending dividers 30 preferably include a plurality of upwardly extending channels 32 periodically spaced along the length of horizontally extending dividers 30. Upwardly extending channels 32 preferably have a keyhole slot configuration which corresponds to protrusions 34 outwardly extending from vertically extending dividers 36. Vertically extending dividers 36 are preferably removable and, if desired, can be separated at protrusions 36 to form storage compartments 38 having various sizes and configuration as desired. Bottom enclosure 12 also includes two (2) additional storage compartments 40 and 42 positioned on either side of handle portion 44. As alluded to above, curved portions 28 present on base portion 18 of bottom enclosure 12 are positioned between adjacent horizontally extending dividers 30 to assist a user in removing relatively small parts stored in storage compartments by providing a smooth radius surface over which the parts can be dragged rather than the sharp corner present between the base portion and the horizontally extending dividers in many prior art storage organizers. In addition, base portion 18 of bottom enclosure includes relatively shallow channels which surround the bottom portion of vertically extending dividers 36 to preclude movement or "migration" of small parts between vertically adjacent storage compartments 38.

Referring now to FIG. 8, first lid member 14 is pivotally attached to rear wall 26 by hinge 27, such as a piano type hinge. Upper surface 46 of first lid member 14 includes bottom surface 48 having a plurality of horizontally extending dividers 48, five (5) of which are present in the first preferred embodiment of storage organizer 10 shown in FIGS. 1 through 9, which extend from side wall 50 to side wall 52. Horizontally extending dividers 48 are preferably permanently affixed to upper surface 46, however, horizontally extending dividers 48 could be removable if desired. Horizontally extending dividers 48 preferably include a plurality of upwardly extending channels 54 periodically spaced along the length of horizontally extending dividers 48. Upwardly extending channels 54 preferably have a keyhole slot configuration which corresponds to protrusions 56 outwardly extending from vertically extending dividers 58. Vertically extending dividers 58 are preferably removable and, if desired, can be separated at protrusions 56 to form storage sections 60 having sizes and configuration as desired. Vertically extending dividers 58 are preferably positioned in corresponding channels in base portion 18 which, in a particularly preferred embodiment, are flush with base portion 18 and extend into base portion 18. First lid member 14 also includes two (2) additional storage compartments 62 and 64 positioned on either side of handle portion 66.

Second lid member 16 is also pivotally attached to rear wall 26 of bottom enclosure 12 by hinge 29. Second lid member 16 includes bottom surface 66 having a series of channels 68 which correspond to and are positioned around horizontally extending dividers 48 and vertically extending dividers 58 when second lid member 16 is closed on first lid member 14. Channels 68 preclude movement or "migration" of small items or parts stored in storage compartments 60 into horizontally and vertically adjacent storage compartments 60. The lower surface of first lid member 14 could also include channels corresponding to horizontally extending dividers 30 and vertically extending dividers 36 to preclude movement or "migration" of the relatively small parts stored therein between vertically and horizontally adjacent storage compartments 38 if desired. Top surface 70 of second lid member 16 includes a plurality of curved portions 72, of which five (5) are present in the first preferred embodiment of storage organizer 10 shown in FIGS. 1 through 9, to enhance the visual appeal of storage organizer 10 and add rigidity and strength and preclude warpage of this surface.

Bottom enclosure 12, first lid member 14 and second lid member 16 are secured together by latching arrangement 72, including pivotally attached latch members 74 which includes first outwardly extending protrusions 76 which engage with and secure second outwardly extending protrusions 78 in second lid member 16. Thus, pivotally attached latch member 74 engages with second lid member 16 and securely holds both first lid member 14 and second lid member 16 to bottom enclosure 12. However, when pivotally attached latch members 74 are disengaged from second lid member 16, first lid member 14 and second lid member 16 remain secured together by secondary latch mechanism 75, which preferably includes two (2) inwardly extending latches 77 on second lid member 16 which engage with corresponding recesses 79 in first lid member 14. Also, when so secured, handle portion 44 and handle portion 66 together form carrying handle 80 which can be used to grasp and transport storage organizer 10 with small items or parts secured therein.

Referring now to FIGS. 10 through 19, a second preferred embodiment of a storage organizer in accordance with the present invention is shown, generally identified by reference numeral 90, which generally includes bottom enclosure 92 and lid member 94. Bottom enclosure 92 includes base portion 96, from which front wall 98, side walls 100 and 102 and rear wall 104 upwardly extend. Base portion 96 of bottom enclosure 92 includes a plurality of curved portions 106, four (4) of which are present in the second preferred embodiment of storage organizer 90 shown in FIGS. 10 through 19. Curved portions 106 enhance the visual appeal of storage organizer 90, add rigidity and strength and preclude warpage of base portion 96 and assist a user in removing relatively small parts stored within storage organizer 90.

Figure 17:
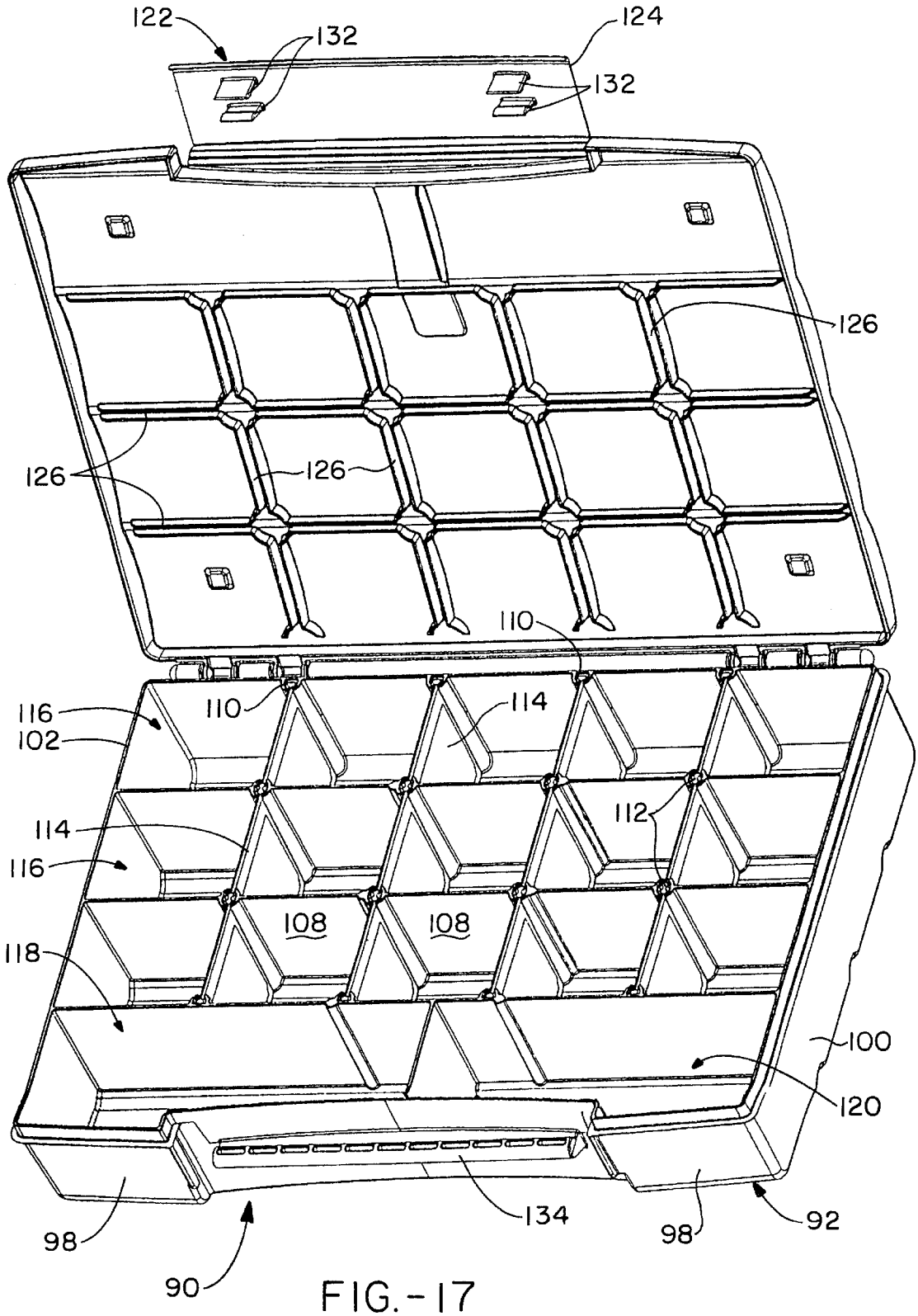
FIG. 17 is a top isometric view of the storage organizer in accordance with the second preferred embodiment of the present invention shown in FIG. 10 with a lid in an open position.
Figures 18, 19:
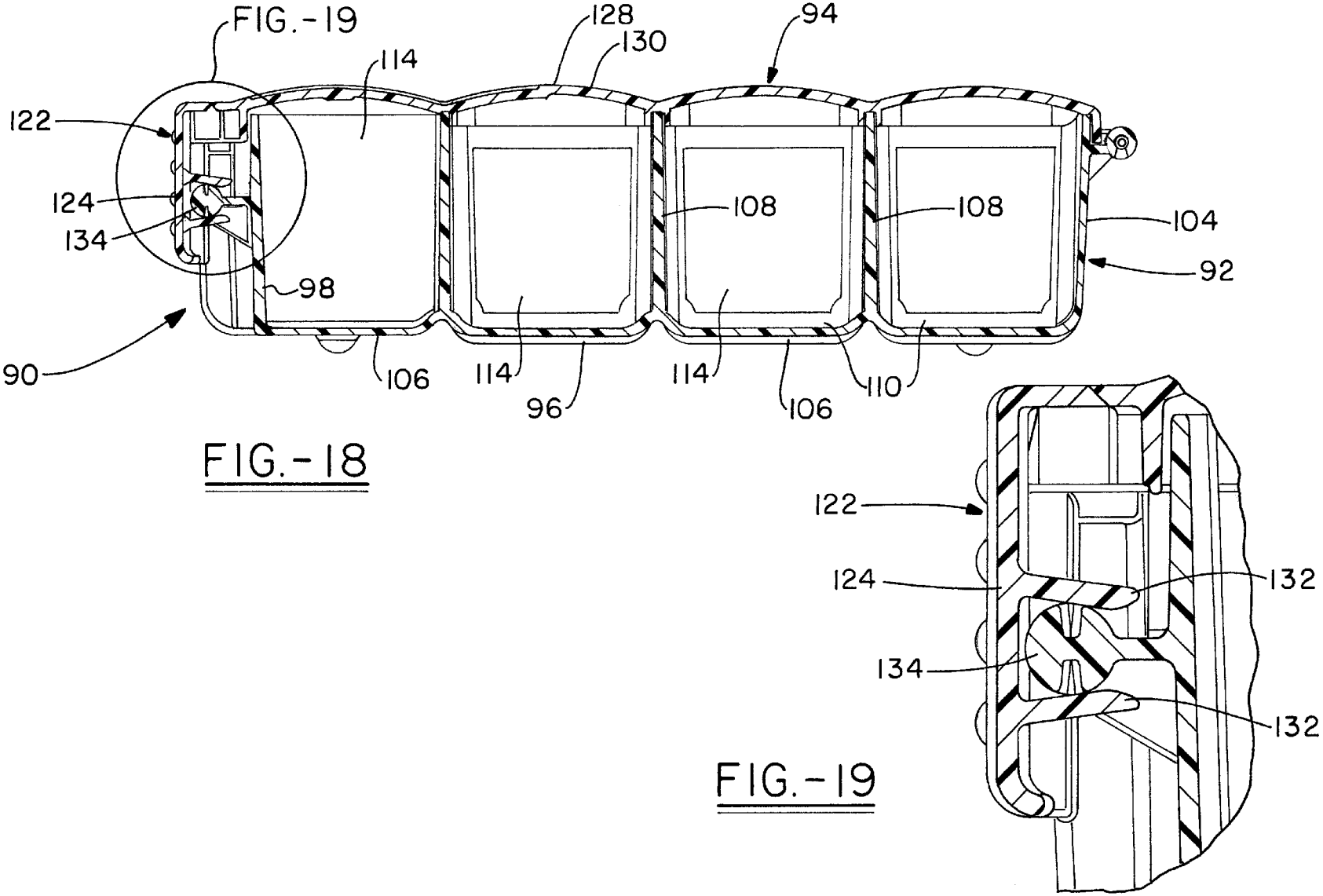
FIG. 18 is a cross-sectional view of the storage organizer in accordance with the second preferred embodiment of the present invention shown in FIG. 10 taken across line 18—18 in FIG. 14.
FIG. 19 is an exploded cross-sectional view of the latching arrangement for the storage organizer in accordance with the second preferred embodiment of the present invention shown in FIG. 10 taken from circle 19—19 in FIG. 18.

As seen in FIG. 17, bottom enclosure 92 includes a plurality of horizontally extending dividers 108, three (3) of which are present in the second preferred embodiment of storage organizer 90 shown in FIGS. 10 through 18, which extend from side wall 100 to side wall 102 Horizontally extending dividers 108 are preferably permanently affixed to bottom enclosure 92, however, horizontally extending dividers 108 could be removable if desired. Horizontally extending dividers 108 preferably include a plurality of upwardly extending channels 110 periodically spaced along the length of horizontally extending dividers 108. Upwardly extending channels 110 preferably have a keyhole slot configuration which corresponds to protrusions 112 outwardly extending from vertically extending dividers 114. Vertically extending dividers 114 are preferably removable and, if desired, can be separated at protrusions 112 to form storage compartments 116 having sizes and configuration as desired. Vertically extending dividers 114 are preferably positioned in corresponding channels in base portion 96 which, in a particularly preferred embodiment, are flush with base portion 96 and extend into base portion 96. Bottom enclosure 92 also includes two (2) additional storage compartments 118 and 120 positioned on either side of latch arrangement 122.

Lid member 94 includes bottom surface 124 having a series of channels 126 which correspond to and are positioned around horizontally extending dividers 108 and vertically extending dividers 114 when lid member 94 is closed on bottom enclosure 92. Channels 126 preclude movement or "migration" of small items or parts stored in storage compartments 116 into adjacent storage compartments. Top surface 128 of lid member 94 includes a plurality of curved portions 130, of which four (4) are present in the second preferred embodiment of storage organizer 90 shown in FIGS. 10 through 19.

Bottom enclosure 92 and lid member 94 are secured together by latching arrangement 122, including pivotally attached latch member 124, which is preferably pivotably connected to lid member 94 by a living or film type hinge, and includes outwardly extending protrusions 132 which engage around a corresponding protrusion 134 outwardly extending from bottom enclosure 92 to secure bottom enclosure to lid member 94 together. When so secured, storage organizer 90 can be carried and transported with small items or parts secured therein.

The various parts of both storage organizers 10 and 90 are preferably fabricated from a rigid durable plastic material, such as polypropylene, although it will be apparent to others having ordinary skill in the relevant art that other materials could be readily used utilizing the teachings of the present invention. In addition, while curved portions on the top and bottom surfaces add to the visual appeal of storage organizers 10 and 90, add rigidity and strength and preclude warpage of these surfaces and assist users in removing relatively small parts from storage organizers 10 and 90, they are preferably sufficiently flat to allow storage organizers 10 and 90 to be stacked on top of one another, and other items can be stacked on top of storage organizers 10 and 90 as well. In addition, the hinges used in storage organizers 10 and 90 are mechanical type hinges, although living or film type hinges could alternatively be used instead.

Although the present invention has been described above in detail, the same is by way of illustration and example only and is not to be taken as a limitation on the present invention. Accordingly, the scope and content of the present invention are to be defined only by the terms of the appended claims.

What is claimed is:

1. A storage organizer, comprising:

a bottom enclosure having an upwardly open storage chamber having a plurality of horizontally extending dividers extending upwardly from a base portion thereof and a plurality of vertically extending channels in said base portion thereof;

a first lid member which covers said upwardly open storage chamber in said bottom enclosure, said first lid member having a bottom surface and a top surface, said bottom surface of said first lid member having a plurality of channels corresponding to said horizontally extending dividers and said vertically extending channels and said too surface of said first lid member having a plurality of horizontally extending dividers extending upwardly therefrom and a plurality of vertically extending channels;

a second lid member which covers said first lid member, said second lid member having a plurality of channels corresponding to said horizontally extending dividers and said plurality of vertically extending channels in said first lid member;

a plurality of vertically extending dividers positioned in said plurality of vertically extending channels in said bottom enclosure to form a plurality of storage compartments between said plurality of horizontally extending dividers and said plurality of vertically extending dividers in said bottom enclosure; and a plurality of vertically extending dividers positioned in said plurality of vertically extending channels on said top surface of said first lid member to form a plurality of storage compartments between said plurality of horizontally extending dividers and said plurality of vertically extending dividers in said first lid member.

* * * * *